US010117474B1

(12) United States Patent
Smith et al.

(10) Patent No.: US 10,117,474 B1
(45) Date of Patent: Nov. 6, 2018

(54) MODULAR INTERCHANGEABLE NECKTIE

(71) Applicants: Ryan Smith, South Ogden, UT (US); Daniel Smith, South Ogden, UT (US)

(72) Inventors: Ryan Smith, South Ogden, UT (US); Daniel Smith, South Ogden, UT (US)

( * ) Notice: Subject to any disclaimer, the term of this patent is extended or adjusted under 35 U.S.C. 154(b) by 0 days.

(21) Appl. No.: 15/849,451

(22) Filed: Dec. 20, 2017

Related U.S. Application Data

(63) Continuation-in-part of application No. 15/822,142, filed on Nov. 25, 2017.

(51) Int. Cl.
*A41D 25/00* (2006.01)
*A41D 25/02* (2006.01)

(52) U.S. Cl.
CPC ..... *A41D 25/005* (2013.01); *A41D 25/003* (2013.01); *A41D 25/02* (2013.01)

(58) Field of Classification Search
CPC ..... A41D 25/005; A41D 25/003; A41D 25/02
See application file for complete search history.

(56) References Cited

U.S. PATENT DOCUMENTS 709,138 A * 9/1902 Chisholm ..... A41D 25/02 2/150
772,801 A * 10/1904 Groll ..... A41D 25/02 2/150
1,270,645 A * 6/1918 Mihelakos ..... A41D 25/02 2/151
2,422,992 A * 6/1947 Taborski ..... A41D 25/02 2/153
2,440,880 A * 5/1948 Taborski ..... A41D 25/02 2/152.1
2,453,733 A * 11/1948 Taborski ..... A41D 25/02 2/150
2,461,854 A * 2/1949 Taborski ..... A41D 25/02 2/153
3,284,807 A * 11/1966 Espino ..... A41D 25/02 2/153
3,735,420 A * 5/1973 New ..... A41D 25/02 2/150
4,368,544 A * 1/1983 Smith ..... A41D 25/025 2/153
5,036,550 A * 8/1991 Wilsey ..... A41D 25/005 2/144
5,084,916 A * 2/1992 Austin ..... A41D 25/02 2/149
5,088,120 A * 2/1992 Yen ..... A41D 25/025 2/150
5,600,852 A * 2/1997 Densch ..... A41D 25/005 2/144

(Continued)

*Primary Examiner* — Richale Quinn
(74) *Attorney, Agent, or Firm* — Kirton McConkie; Brian Tucker

(57) ABSTRACT

A modular necktie includes a knot enclosure having an attachment channel, a fabric stem that is configured to insert into the attachment channel, and a tie portion that is secured to the fabric stem such that the tie portion extends downwardly from the knot enclosure when the fabric stem is inserted into the attachment channel. The knot enclosure can couple to a wearer's shirt in various ways including via a recess that is configured to receive a button of a wearer's shirt or via lateral collar wings that allow a collar band or ratcheting strips to be used. Various types of electronic components can be included in the knot enclosure.

20 Claims, 21 Drawing Sheets

(56) References Cited

U.S. PATENT DOCUMENTS

| | | | | | |
|---|---|---|---|---|---|
| 5,673,434 | A * | 10/1997 | Risk | A41D 25/005 | 2/144 |
| 5,774,893 | A * | 7/1998 | Torres | A41D 25/025 | 2/148 |
| 5,778,453 | A * | 7/1998 | Chen | A41D 25/025 | 2/148 |
| 6,249,427 | B1 * | 6/2001 | Carroll | G06F 1/1616 | 361/679.03 |
| 6,691,319 | B1 * | 2/2004 | Simon | A41D 25/025 | 2/144 |
| 7,458,105 | B2 * | 12/2008 | Tao | A41D 25/025 | 2/144 |
| D767,247 | S * | 9/2016 | Sbarigia | D2/605 | |
| 9,781,961 | B2 * | 10/2017 | Erickson | A41D 25/027 | |
| 2015/0047095 | A1 * | 2/2015 | Evans | A41D 25/005 | 2/148 |
| 2016/0363839 | A1 * | 12/2016 | Delaney | G03B 17/561 | |
| 2017/0006944 | A1 * | 1/2017 | Erickson | A41D 25/10 | |

* cited by examiner

MODULAR INTERCHANGEABLE NECKTIE

CROSS-REFERENCE TO RELATED APPLICATIONS

This application is a continuation-in-part of U.S. patent application Ser. No. 15/822,142 which was filed on Nov. 25, 2017.

BACKGROUND

This invention relates to neckties and menswear and more particularly relates to detachable synthetic neckties.

Neckties are well known in the art and have become a staple of common business attire. Conventional neckties comprise an elongated strip of fabric commonly tied at the neck using knots known to those of skill in the art, including the Windsor knot, the Christensen knot, the Merovingian knot, the small knot, and the like. Other types of neckties also proliferate in the art, including bowties.

Neckties have evolved slowly over centuries and continue to evolve with provision of the present invention. Roman soldiers adorned themselves in scarves and neckwear as part of their uniforms and the concept of the necktie in menswear grew slowly through Europe subsequently. In medieval battles, including the Thirty Years' War and the Battle of Steenkerque, officers commonly wrapped cravats around their necks and twisted the ends of the fabric cravats together, passing the twisted portions through a buttonhole. These cravats were sometimes used in the battlefield as tourniquets.

With the industrial revolution, cravats gave way to leather collars and finally to more traditional neckties arraying a series of knots and styles. These traditional neckties are not entirely efficient, however. Traditional neckties still include the collar band, which is uncomfortable particularly in the heat, and are difficult and time consuming to tie. The collar band is useless and not even visible under the collar. It can be difficult to interchange traditional neckties and these inefficiencies have given way to abandonment of the necktie altogether by some professionals in hot or casual business environments.

Previous attempts to remedy these inefficiencies have been made in the art, including with the evolution of "clip-on" neckties, which eliminate the neckband of the tie and provide alternate means of collar attachment which simulates the Windsor knot. Clip-on neckties often shown the clip, do not allow interchange of the elongated fabric portion of the tie, do not allow customizable knots, and do not include simulated knots beyond those previously known in the art. As the art, stylistic preferences of wearers, and manufacturing technologies continue to evolve, so too do neckties.

It is desirable to provide to the modern man a more efficient necktie with modularized, rapidly-interchangeable components adaptable to meet a variety of stylistic and aesthetic preferences, which makes use of improved manufacturing and design technologies.

BRIEF SUMMARY

The present invention provides a modular necktie comprising: a simulated knot having a declined rearward surface, the declined rearward surface defining a recess for receiving a magnetic element, the simulated knot defining a non-cylindrical attachment channel for receiving a fabric stem, the simulated knot affixable to one of a shirt collar and collar band; a fabric stem adapted to affix at a distal end to an elongated necktie and a proximal end to the knot enclosure, the fabric stem comprising: a noncylindrical proximal head adapted to engage the attachment channel, the proximal head comprising attachment means; a shank; a terminal fastener adapted to fasten to a fabric tie.

The fabric stem may further comprise a plurality of bulbous flanges. The proximal head of fabric stem may further comprise magnetic element for forming a magnetic dipole bond with a cooperating magnetic element in the knot enclosure.

The knot enclosure may further comprise, in some embodiments, a magnetic element for forming a magnetic dipole bond with a cooperating magnetic element in the fabric stem. An exterior surface of the knot enclosure may be faceted. The knot enclosure may define a cylindrical attachment recess. A floor of the cylindrical attachment recess may define a magnetic attachment recess. The modular necktie may further comprise an elongated strip of fabric forming a tie affixed to the fabric stem.

The modular necktie, in some embodiments, may further comprise: an internal power supply; a microphone; and a transmitter for wirelessly transmitting audio data received via the microphone; wherein the modular necktie is adapted to receive spoken audio data via the microphone and transmit said spoken audio to a receiver. The modular necktie may be adapted to wirelessly relay digital audio information using Bluetooth® protocols.

The modular necktie may comprise: a simulated knot having a declined rearward surface, the declined rearward surface, the simulated knot affixable to one of a shirt collar and collar band using attachment means, the simulating knot detachably affixable to one of a fabric stem and a tie using attachment means; an internal power supply; a microphone; and a transmitter for wirelessly transmitting audio data received via the microphone.

A second modular necktie is provided comprising: a simulated knot having a declined rearward surface, the simulated knot defining a non-cylindrical attachment channel for receiving a fabric stem, the simulated knot affixable to one of a shirt collar and collar band; a fabric stem adapted to affix at a distal end to an elongated necktie and a proximal end to the knot enclosure, the fabric stem comprising: a noncylindrical proximal head adapted to engage the attachment channel, the proximal head comprising attachment means; a shank; attachment means for affixing to a fabric tie.

The modular necktie may further comprise: an internal power supply; a microphone; and a transmitter for wirelessly transmitting audio data received via the microphone; wherein the modular necktie is adapted to receive spoken audio data via the microphone and transmit said spoken audio to a receiver. The modular necktie may be adapted to wirelessly relay digital audio information using Bluetooth® protocols.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
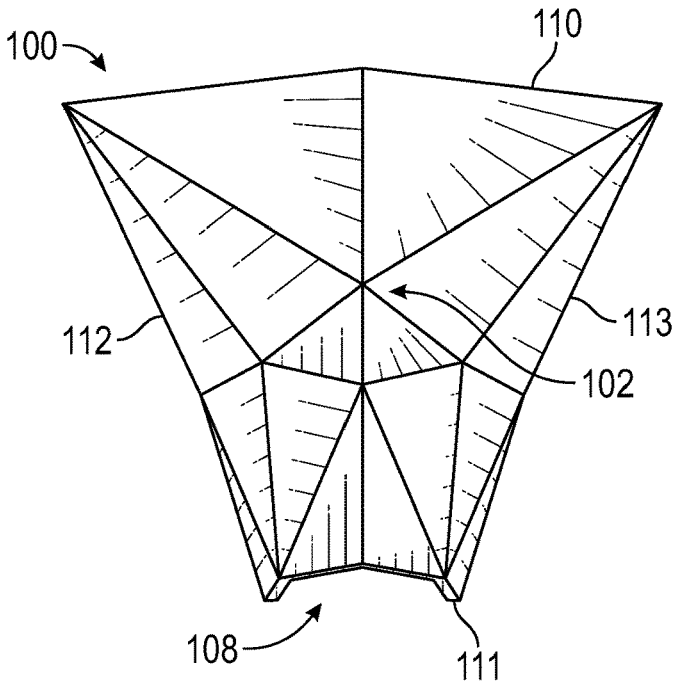
FIG. 1A is a forward perspective view of an interchangeable knot enclosure of modular necktie in accordance with the present invention.

FIG. 1A is a forward perspective view of an interchangeable knot enclosure 100 of a modular necktie in accordance with the present invention. Knot enclosure 100 or knot receptacle comprises a top edge 110, a bottom edge 111, a convex front surface 102 that extends between top edge 110 and bottom edge 111, a top rear surface 122*a*, a bottom rear surface 122*b*, and opposing sides 112, 113 that connect front surface 122*a* to rear surfaces 122*a*, 122*b*. Front surface 102 may be shaped to simulate any knot commonly-known to those of skill in the art, including a Windsor, half-Windsor, Atlantic knot, Nicky knot, small knot, Merovingian knot, and the like. In other embodiments, including that shown, knot enclosure 100 is faceted in a tapering aesthetically-pleasing style, though not one perfectly simulating common necktie knots. Knot enclosure 100 may form any other generally downwardly-tapering shape.

Knot enclosure 100 may be formed from any polymeric, metallic, fabric or organic material known to those of skill in the art, including Titanium, Aluminum, metal alloy, nylon, leather, woven silk, and the like. Knot enclosure 100 may comprise any decorative exterior surfacing or colors.

Figure 1B:
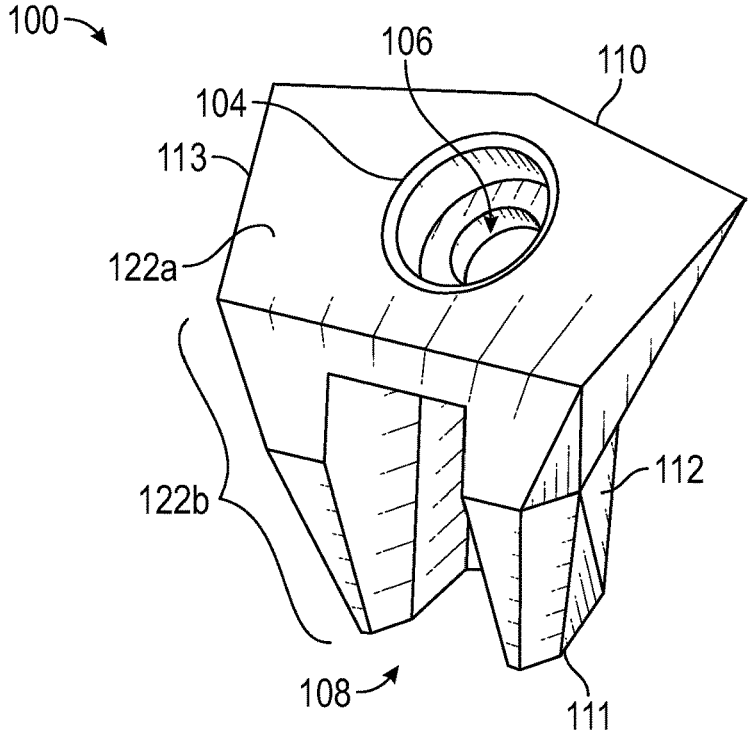
FIG. 1B is an upper, rearward perspective view of an interchangeable knot enclosure of modular necktie in accordance with the present invention.

FIG. 1B is an upper, rearward perspective view of knot enclosure 100. As shown, top rear surface 122*a* is angled relative to bottom rear surface 122*b* to correspond to the relative angle between a wearer's neck and torso. Top rear surface 122*a* includes an attachment recess 104 which functions to receive the top button of the wearer's shirt. An inner surface of attachment recess 104 defines a magnetic element recess 106 for receiving a first magnetic element. In other embodiments, magnetic element recess 106 could be replaced with another suitable attachment structure such as hook and loop fasteners, friction fit fasteners, etc.

In embodiments that employ magnetic elements, the first magnet element may be plated so as to help prevent corrosion and/or to help strengthen the magnet material. In one embodiment, a neodymium magnet is coated with nickel or plastic, yet other options for coatings include zinc, tin, copper, epoxy, silver, and gold, for example.

A cooperating second magnetic element is disposed or positioned on a collar band which may comprise another magnet having an opposite polarity than the first magnetic element. The second magnetic element may comprise a metallic article that is magnetically attracted to the first magnetic element. The first and second magnetic elements may have the same size and shape. In the shown embodiments, the first magnetic element is disc-shaped. One of ordinary skill will recognize that a variety of sizes and/or shapes may be used for the first and second magnetic elements and that the sizes and/or shapes of the two magnetic elements need not be identical.

An attachment channel 108 or socket extends vertically within knot enclosure 100 and forms an opening at bottom edge 111. As shown, attachment channel 108 may also form a rearward facing opening that extends vertically along bottom rear surface 122*b*. In some embodiments, attachment channel 108 is not cylindrical so as to prevent axial rotation of a fabric stem 200 (see FIG. 2) and tie affixed to knot enclosure 100 within attachment channel 108. Although not shown, a top surface of attachment channel 108 can include a magnet or other type of fastener to secure a fabric stem as will be described below.

Figure 2:
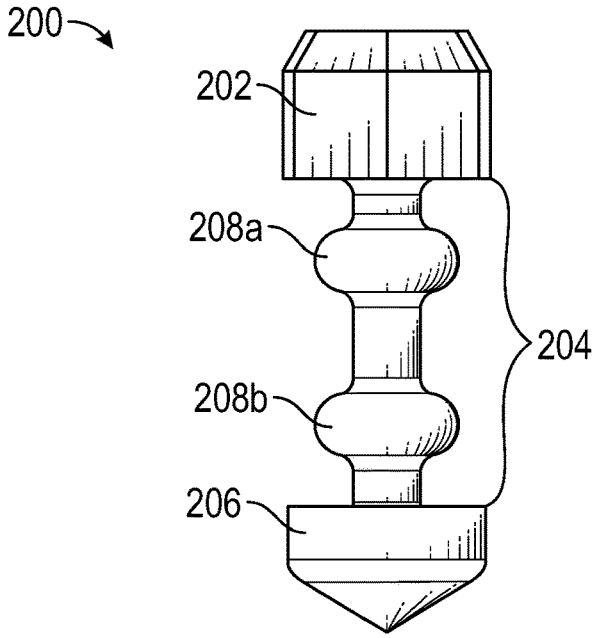
FIG. 2 is a forward perspective view of a detachable fabric stem of modular necktie in accordance with the present invention.

FIG. 2 is a forward perspective view of a detachable fabric stem 200 of a modular necktie in accordance with the present invention. Fabric stem 200 comprises a proximal head 202, a shank 204 having two bulbous flanges 208*a-b*, and a terminal fastener 206 at the distal end of shank 204.

Figure 3:
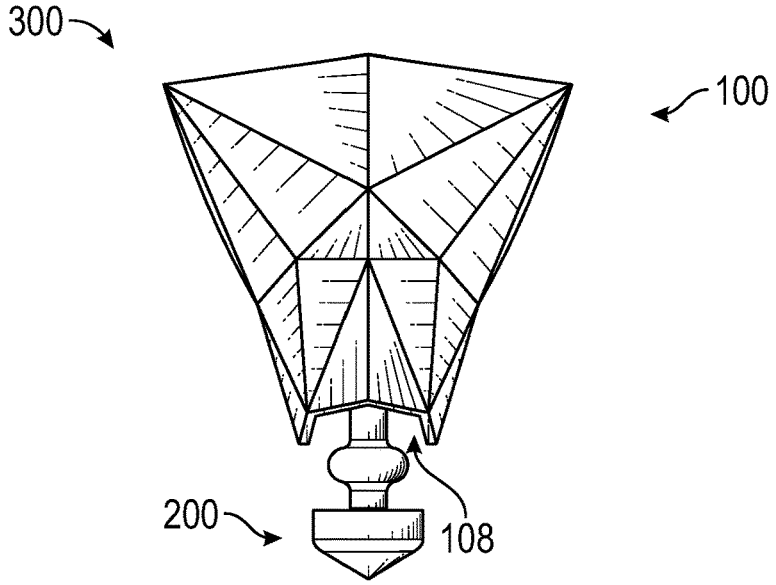
FIG. 3 is a forward perspective view of a modular necktie in accordance with the present invention.

FIG. 3 is a forward perspective view of a modular necktie 300 in accordance with the present invention. As shown, fabric stem 200 is detachably inserted into attachment channel 108 to thereby secure fabric stem 200 to knot enclosure 100. A fabric tie can be affixed around fabric stem 200 and/or to the terminal end of fabric stem 200.

Figure 4A:
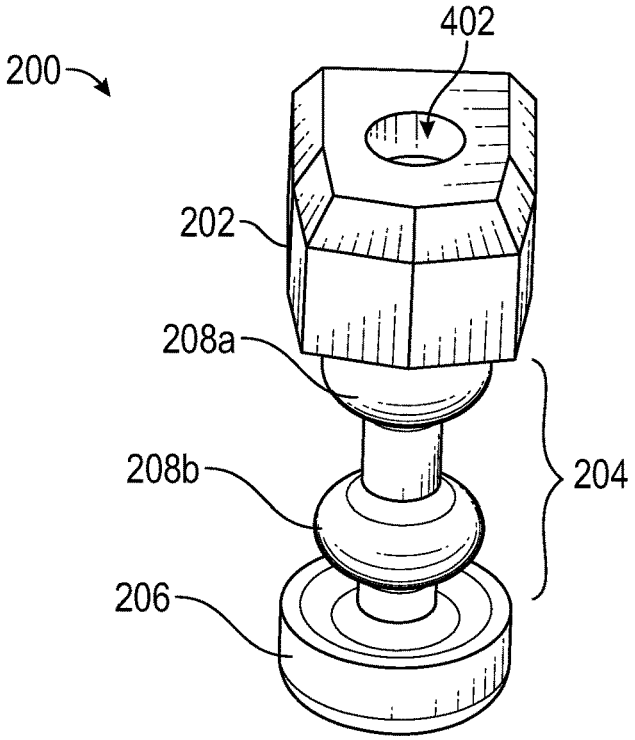
FIG. 4A is an upper, forward perspective view of a detachable fabric stem of a modular necktie in accordance with the present invention.

FIG. 4A is an upper, forward perspective view of fabric stem 200 in accordance with one or more embodiments. Proximal head 202 of fabric stem 200 is non-cylindrical to prevent axial rotation of fabric stem 200 within knot enclosure 100. Proximal head 202 may be tapered upwardly and may comprise a planar top surface defining a hollow cylindrical recess 402 for receiving a magnetic element adapted to engage using magnetic force a corresponding magnet (e.g., magnet 802 shown in FIG. 8D) contained at a top surface of attachment channel 108.

Figure 4B:
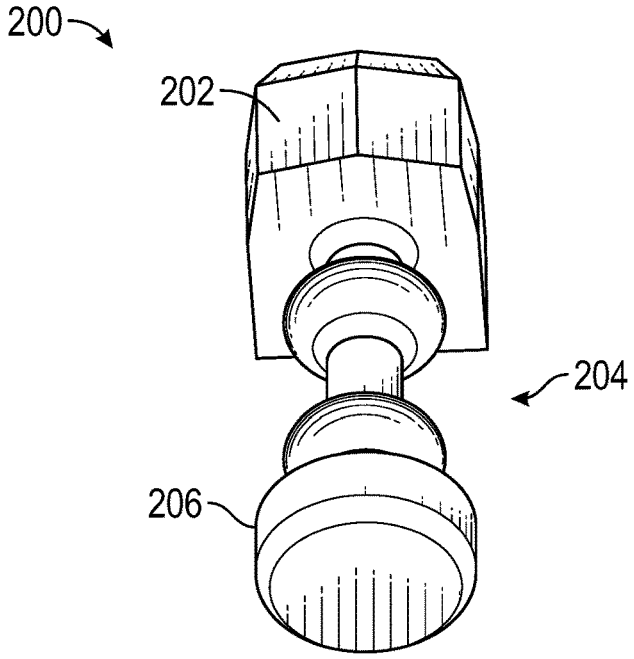
FIG. 4B is a lower, forward perspective view of a detachable fabric stem of a modular necktie in accordance with the present invention.

Fabric stem 200 comprises cylindrical shank 204 and terminal fastener 206 at the distal end of shank 204 for enabling affixation of fabric stem 200 with a tie portion of elongated fabric material. Shank 204 may comprise a plurality of bulbous flanges 208*a-b* as shown for further facilitating engagement with the tie portion. FIG. 4B is a lower, forward perspective view of fabric stem 200 shown in FIG. 4A. Terminal fastener 206 may comprise a planar bottom surface as shown.

Figure 5:
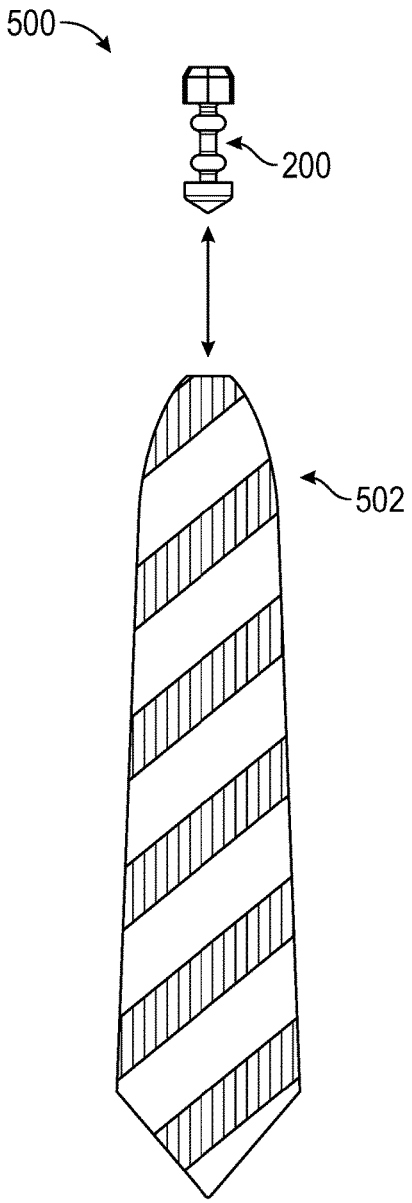
FIG. 5 is a forward perspective view of a disassembled detachable fabric stem and tie of a modular necktie in accordance with the present invention.

FIG. 5 is a forward perspective view of a disassembled detachable fabric stem 200 and tie portion 502 of a modular necktie 500 in accordance with the present invention. Tie portion 502 is affixed to fabric stem 200. Fabric stem 200 inserts into tie portion 502 and/or is enveloped or partially enveloped by tie portion 502. Tie portion 502 may be affixed to fabric stem 200 using any means known to those of skill in the art, including lashing, a knot, adhesive, or fasteners.

Figure 6:
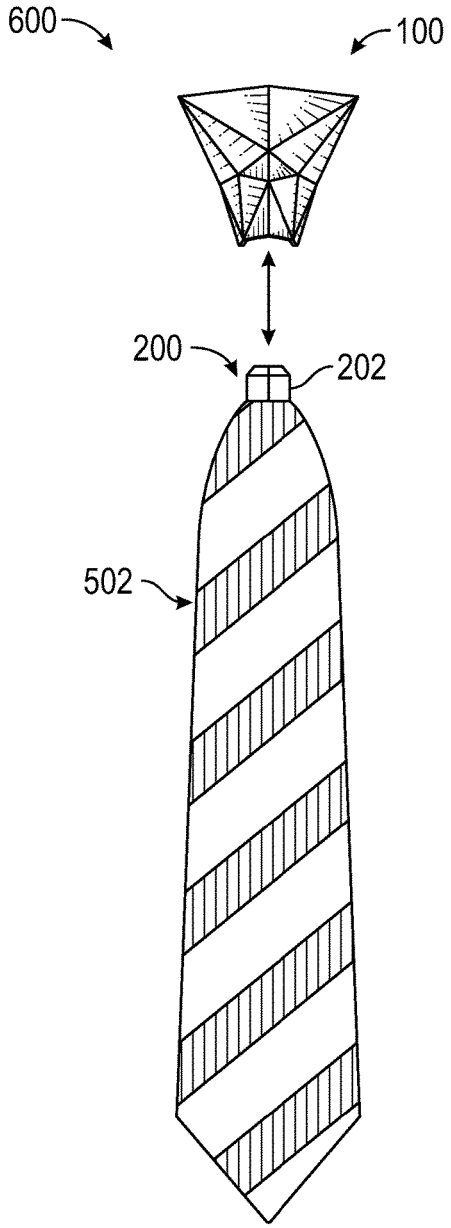
FIG. 6 is a forward perspective view of a disassembled modular necktie in accordance with the present invention.

FIG. 6 is a forward perspective view of a disassembled modular necktie 600 in accordance with the present invention. Fabric stem 200 is inserted into tie portion 502 so that proximal head 202 of fabric stem 200 is positioned and protruding upwardly above tie portion 502. In other words, tie portion 502 can be wrapped around and secured to shank 204 while leaving proximal head 202 exposed. Bulbous flanges 208*a-b* can form surfaces to prevent tie portion 502 from sliding downwardly relative to proximal head 202. With proximal head 202 exposed, it can be inserted into attachment channel 108 until the magnetic elements or other fasteners couple together thereby securing tie portion 502 to knot enclosure 100. The insertion of proximal head 202 into and the removal of proximal head 202 from attachment channel 108 is facilitated by configuring attachment channel 108 to form the rearward facing opening that extends upward along bottom rear surface 122*b*.

Figure 7:
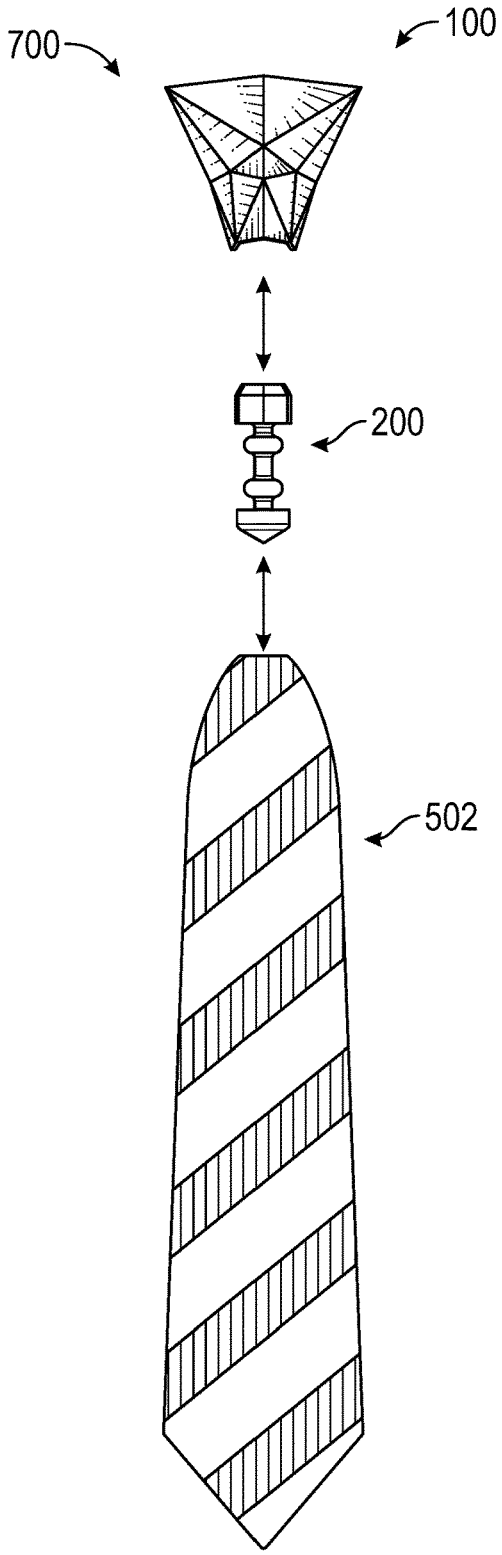
FIG. 7 is a forward perspective view of a disassembled modular necktie in accordance with the present invention.

FIG. 7 is a forward perspective view of a disassembled modular necktie 700 in accordance with the present invention. Knot enclosure 100, fabric stem 200, and tie portion 502 position together as shown.

Figure 8A:
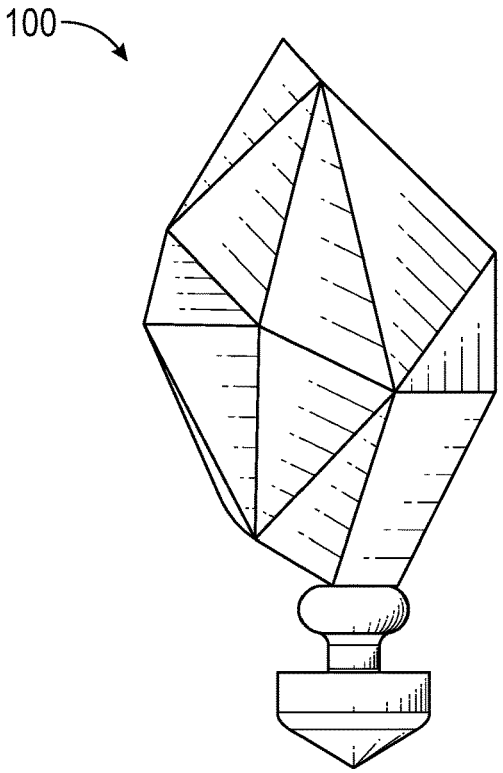
FIG. 8A is a side perspective view of an interchangeable knot enclosure of modular necktie in accordance with the present invention.
Figure 8B:
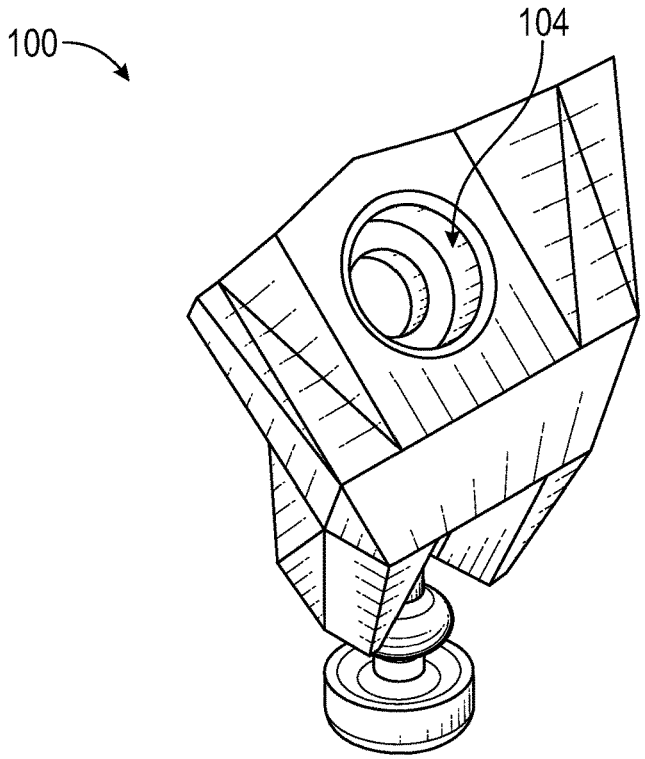
FIG. 8B is an upper, forward perspective view of an interchangeable knot enclosure of modular necktie in accordance with the present invention.
Figure 8C:
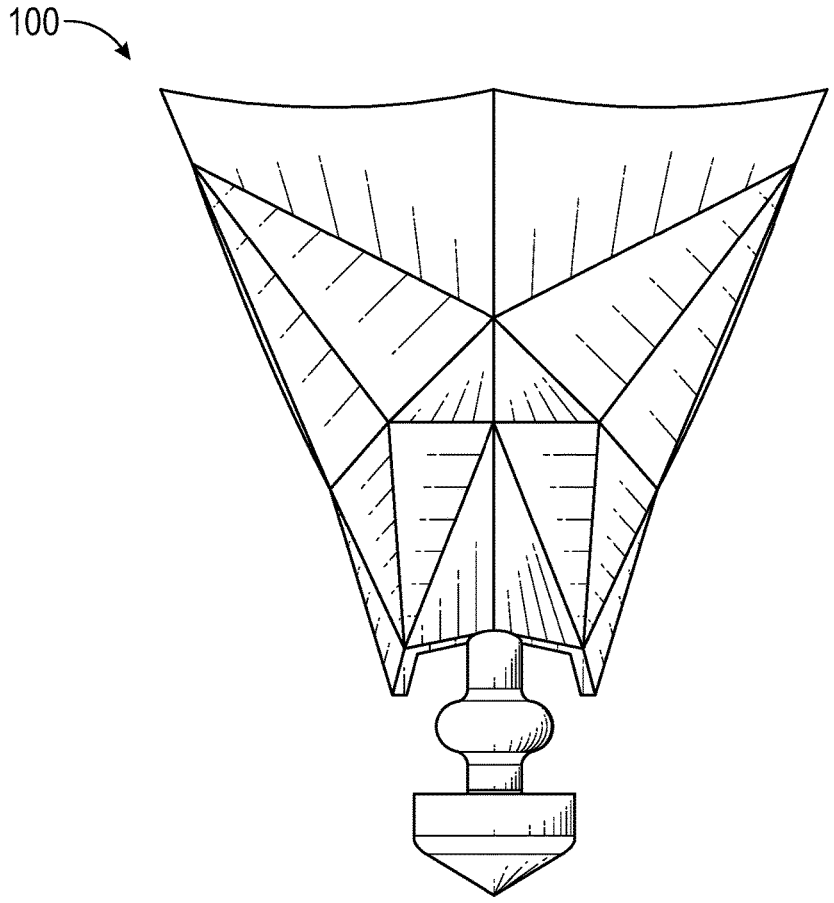
FIG. 8C is a forward perspective view of an interchangeable knot enclosure of modular necktie in accordance with the present invention.
Figure 8D:
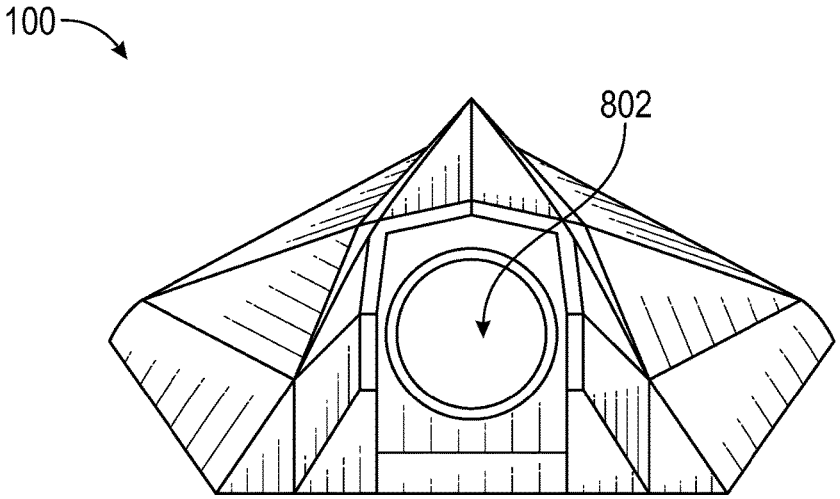
FIG. 8D is an upper perspective view of an interchangeable knot enclosure of modular necktie in accordance with the present invention.
Figure 8E:
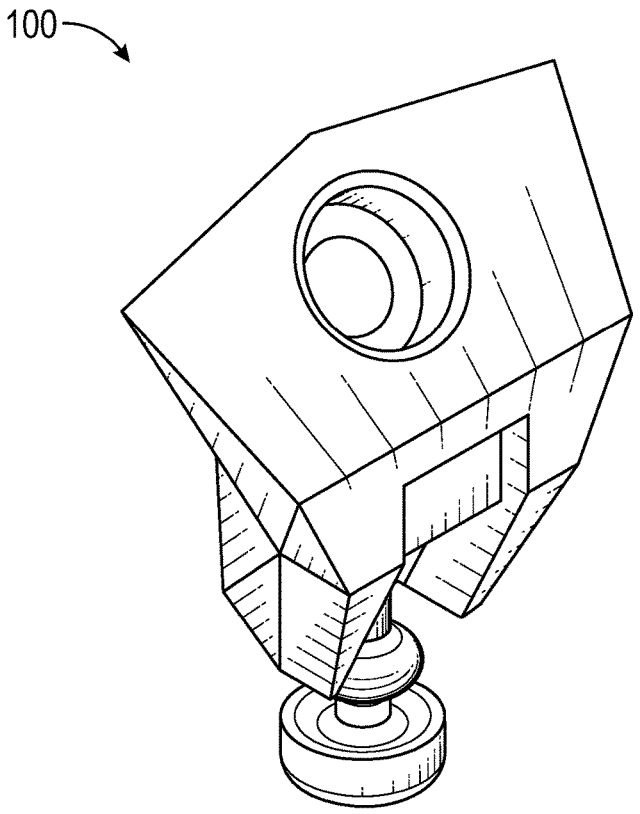
FIG. 8E is an upper, rearward perspective view of an interchangeable knot enclosure of modular necktie in accordance with the present invention.

FIGS. 8A-8 E demonstrate various perspective views of alternate embodiments of interchangeable knot enclosures 100. Knot enclosure 100 may comprise a magnetic element 802 or other fastener as referenced above.

Figure 9:
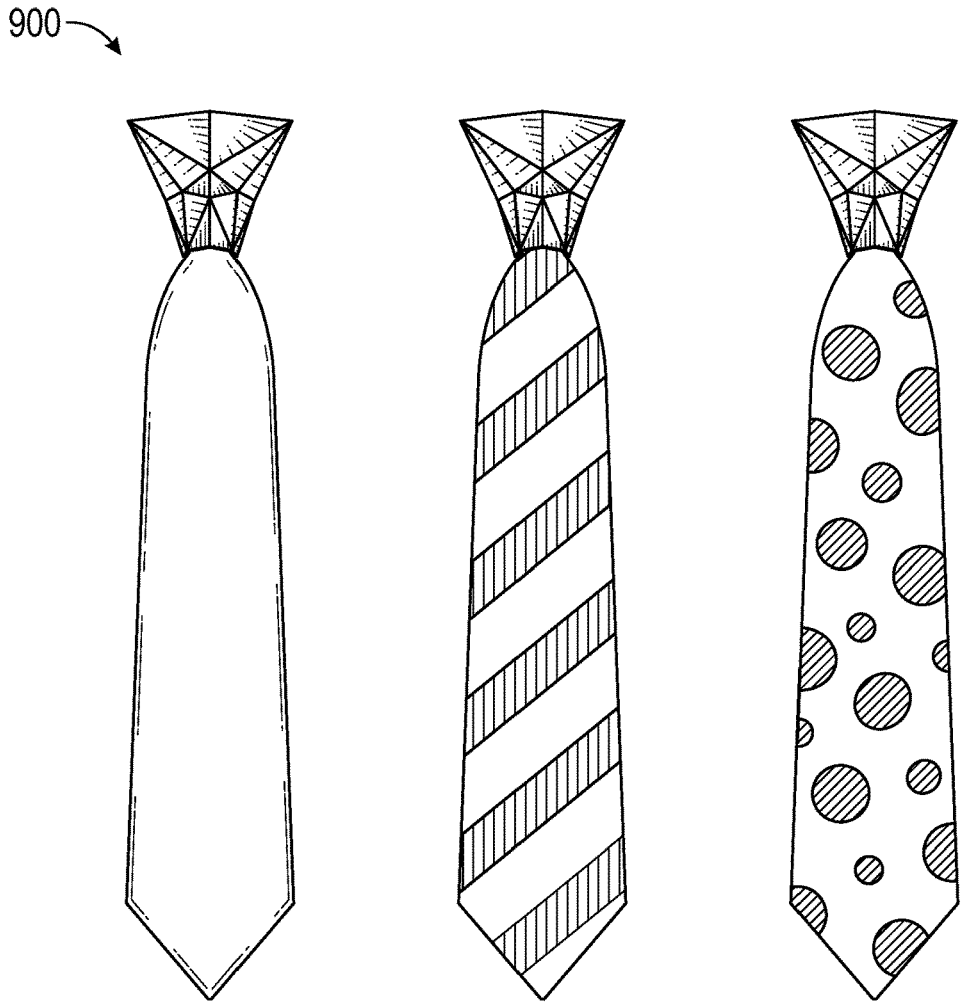
FIG. 9 is a forward perspective view of a collection of three assembled modular neckties in accordance with the present invention.
Figure 10:
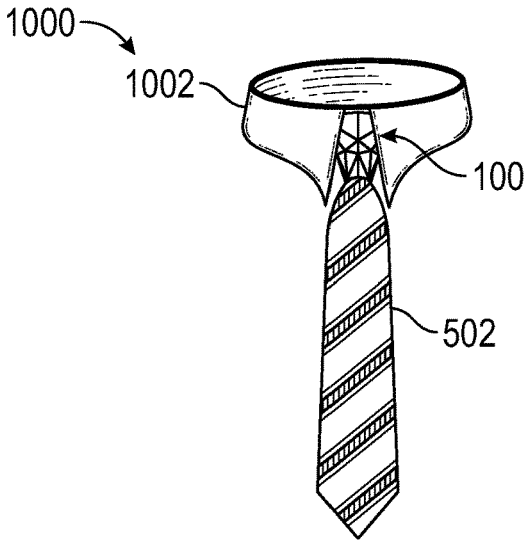
FIG. 10 is an environmental perspective view of a modular necktie in accordance with the present invention.

FIG. 9 is a forward perspective view of a collection of three assembled modular neckties 900 in accordance with the present invention. Fabric stem 200 is hidden in each assembled modular necktie from the forward perspective. FIG. 10 is an environmental perspective view of a modular necktie 1000 in accordance with the present invention. Knot enclosure 100 positions partially behind the collar 1002 of a shirt with tie portion 502 hanging downwardly from knot enclosure 100. Modular necktie 1000 therefore has the general appearance of a typical necktie.

Figure 11A:
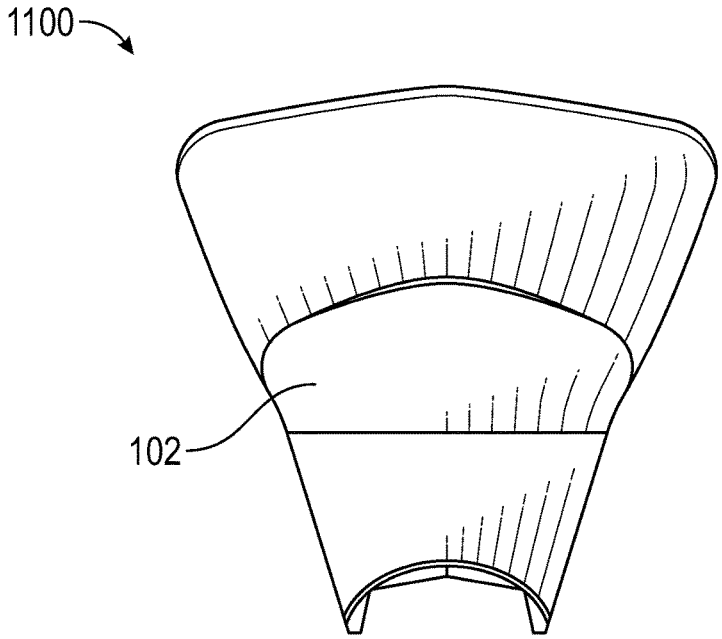
FIG. 11A is a forward perspective view of an interchangeable knot enclosure of modular necktie in accordance with the present invention.
Figure 11B:
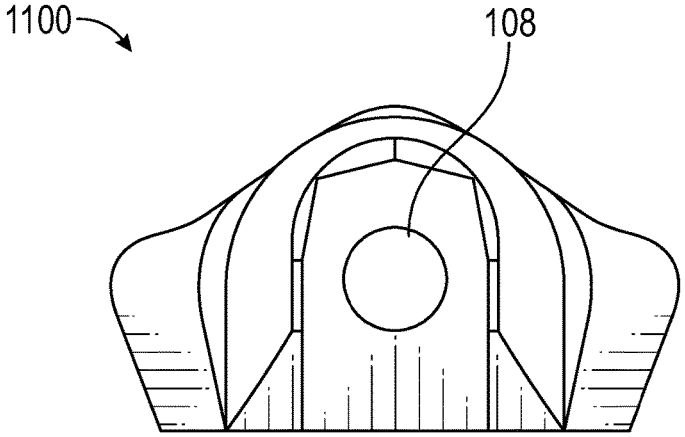
FIG. 11B is an upper perspective view of an interchangeable knot enclosure of modular necktie in accordance with the present invention.

FIGS. 11A-11B illustrate perspective views of an interchangeable knot enclosure 1100 of a modular necktie in accordance with the present invention. Knot enclosure 1100 may comprise smooth outer surfacing/styling as shown.

Figure 12A:
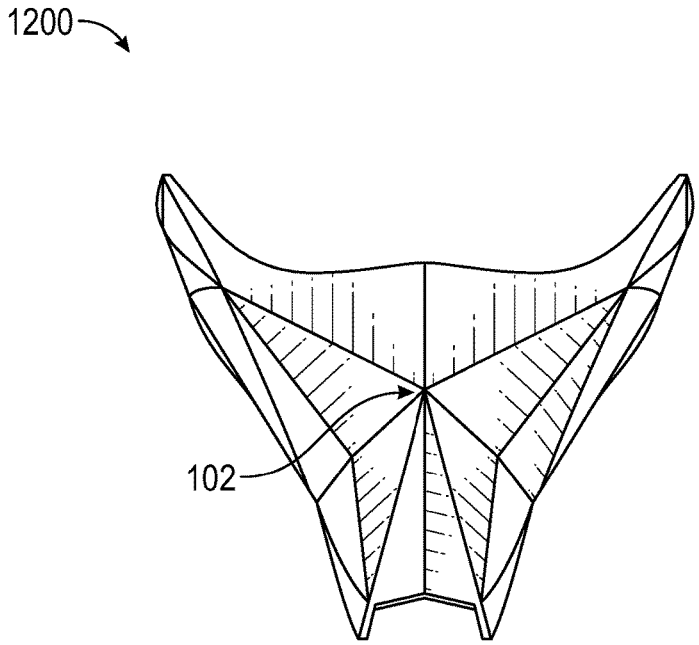
FIG. 12A is a forward perspective view of an interchangeable knot enclosure of modular necktie in accordance with the present invention.
Figure 12B:
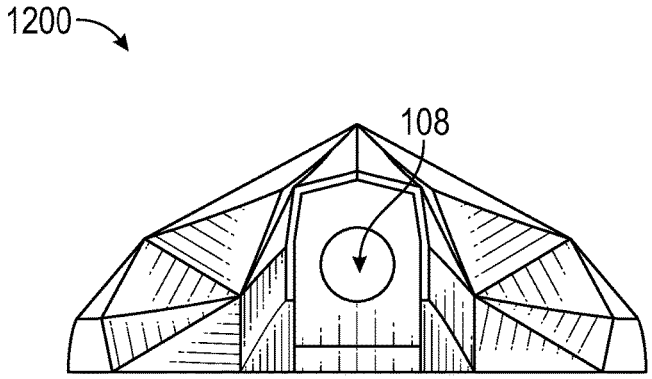
FIG. 12B is an upper perspective view of an interchangeable knot enclosure of modular necktie in accordance with the present invention.

FIGS. 12A-12B illustrate perspective views of an interchangeable knot enclosure 1200 of a modular necktie in accordance with the present invention. Knot enclosure 1200 may comprise laterally-rising wings as shown for increased projection into a wearer's collar.

Figure 13A:
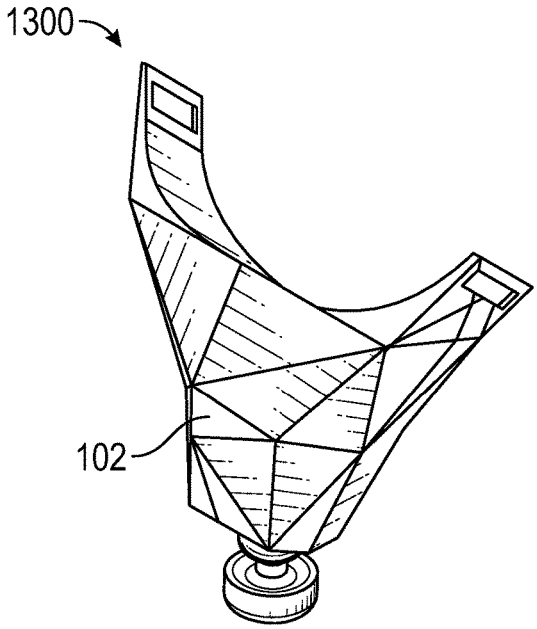
FIG. 13A is an upper, forward perspective view of an interchangeable knot enclosure of modular necktie in accordance with the present invention.
Figure 13B:
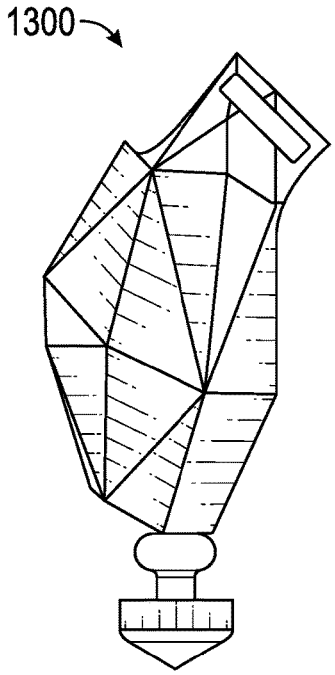
FIG. 13B is a side perspective view of an interchangeable knot enclosure of modular necktie in accordance with the present invention.
Figure 13C:
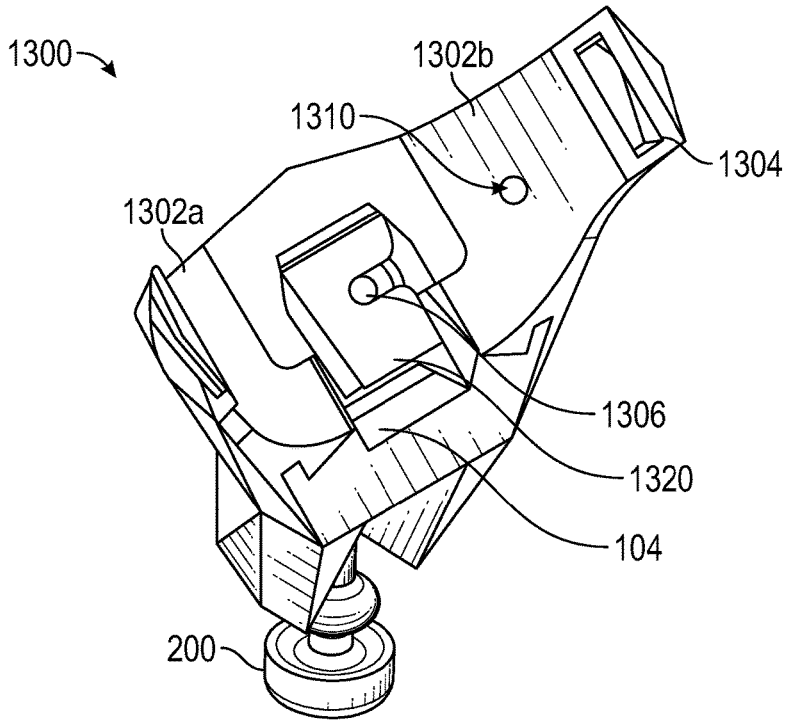
FIG. 13C is a side, rearward perspective view of an interchangeable knot enclosure of modular necktie in accordance with the present invention.
Figure 14:
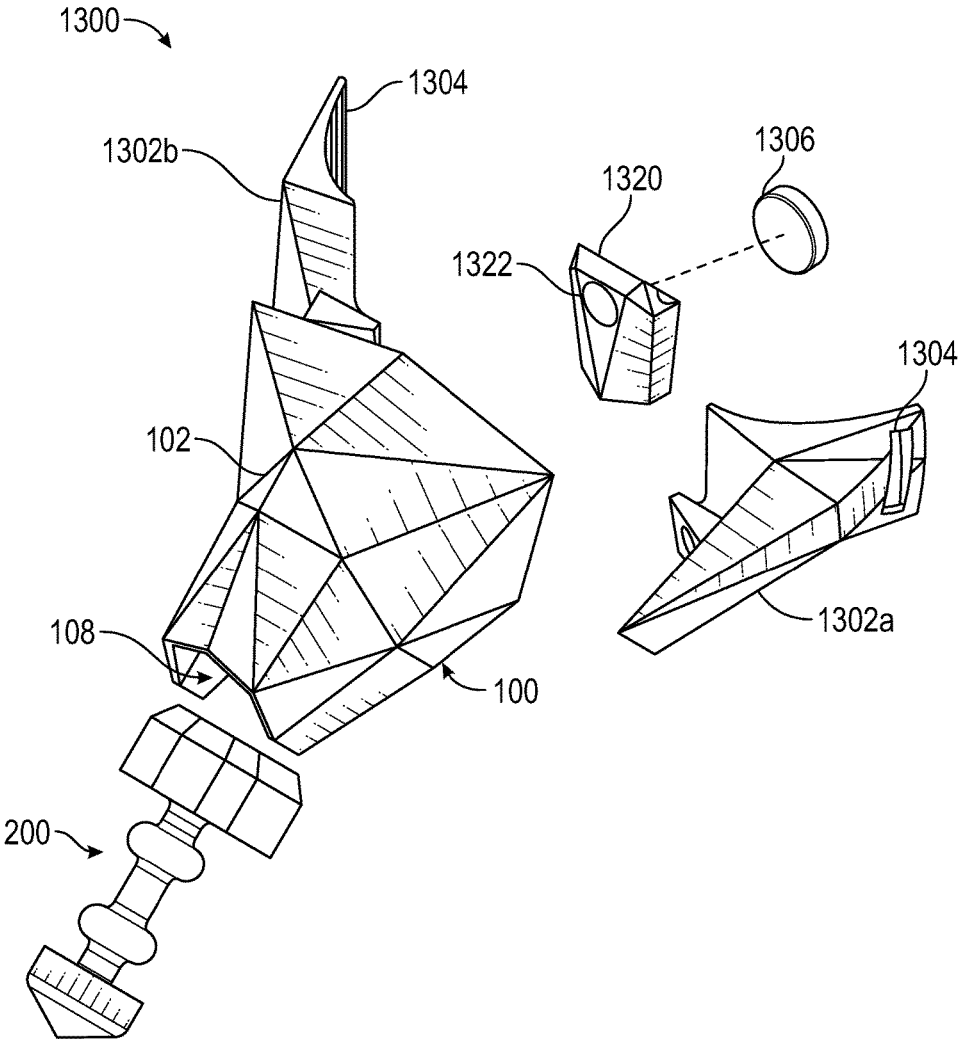
FIG. 14 is a disassembled perspective view of an interchangeable knot enclosure of modular necktie in accordance with the present invention.

FIG. 13A-13C illustrate perspective views and FIG. 14 illustrates an exploded view of an interchangeable knot enclosure 1300 of a modular necktie in accordance with the present invention. Knot enclosure 1300 comprises two detachable lateral collar wings 1302*a* and 1302*b* each having a collar band fastener 1304 formed at an outer and rearward end. Collar band fasteners 1304 can be used to couple a collar band that wraps around the wearer's neck to knot enclosure 1300.

Lateral collar wings 1302*a* and 1302*b* engage knot enclosure 1300 using attachment means 1310 as shown. Attachment means 1310 may be a magnet which couples to a corresponding magnet contained in knot enclosure 1300 or another type of fastener such as a friction fit fastener, snap-fit fastener, screws, etc.

As shown in FIG. 13C, attachment recess 104 has a rectangular shape and is configured to receive and secure a button attachment component 1320. Button attachment component 1320 is configured to selectively receive a button 1306 of the wearer's shirt. In use, button attachment component 1320 can be coupled to button 1306 and then knot enclosure 1300 can be coupled to button attachment component 1320 to thereby secure knot enclosure 1300 to the wearer's top button. Due to its configuration, knot enclosure 1300 can be coupled to the wearer's shirt using either button attachment component 1320 to couple to the top button or a collar band that extends between collar band fasteners 1304. In other embodiments, knot enclosure 1300 may include only attachment component 1320 or only collar band fasteners 1304.

Figure 15:
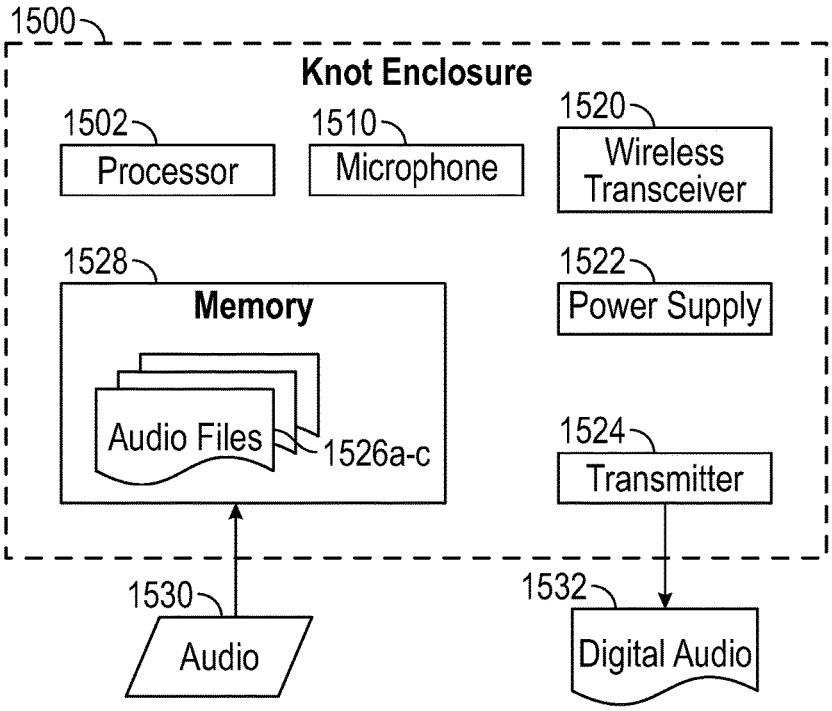
FIG. 15 is a block diagram illustrating interior electrical components of a knot enclosure of modular necktie in accordance with the present invention.

FIG. 15 is a block diagram illustrating interior electrical components of a knot enclosure 1500 of modular necktie in accordance with the present invention. Knot enclosure 1500 may comprises a processor 1502, a wireless transceiver 1520, a microphone 1510, a power supply 1522, a wireless transmitter 1524, and a memory 1528 comprising a plurality of audio files 1526*a-c*.

In various embodiments, audio input 1530 is received by microphone 1510 and spoken by a wearer. This audio may be retransmitted using protocols and means known to those of skill in the art, including BlueTooth® to a remote data processing device (DPD) such as a tablet computer, smart phone, server, personal computer, amplifier, and the like. In various embodiments, the remote DPD is in wireless connectivity with knot enclosure 1500 via a local area network (LAN) or wide area network (WAN). The data output is noticed at 1532.

Knot enclosure 1500 may comprise means for relaying electrical signals enabling device-to-device communication (meaning wireless transmission of media). Knot enclosure 1500 may be configured to make use of the Bluetooth® protocols and procedures enabling device-to-device intercommunication connectivity. This functionality may be provided by incorporating the Bluetooth Intercom Profile® and/or the Bluetooth Telephony Profile, or other wireless technologies known to those of skill in the art.

This communication may be in accordance with core specifications of one or more subsets of Bluetooth® profiles, wherein the core specifications comprise one or more of: the Cordless Telephony Profile (CTP), the Device ID Profile (DIP), the Dial-up Networking Profile (DUN), the File Transfer Profile (FTP), the Hands-Free Profile (HFP), the Human Interface Device Profile (HID), the Headset Profile (HSP), and the Intercom Profile (ICP), the Proximity Profile (PXP).

FIGS. 16A-16D illustrate another embodiment of a modular necktie 1600 that employs knot enclosure 1300. In this embodiment, modular necktie 1600 includes a collar band 1601 having a first magnetic end 1601*a* and a second magnetic end 1601*b*. At least a portion of the length of collar band 1601 can be made of or incorporate a magnetic material so that magnetic ends 1601*a* and 1601*b* will be held securely to collar band 1601 when the ends are threaded through collar band fasteners 1304 and folded back onto collar band 1601. By incorporating magnetic material along the length of collar band 1601, the diameter of collar band 1601 can be adjusted to fit a particular wearer's neck size or preferences.

Figure 16A:
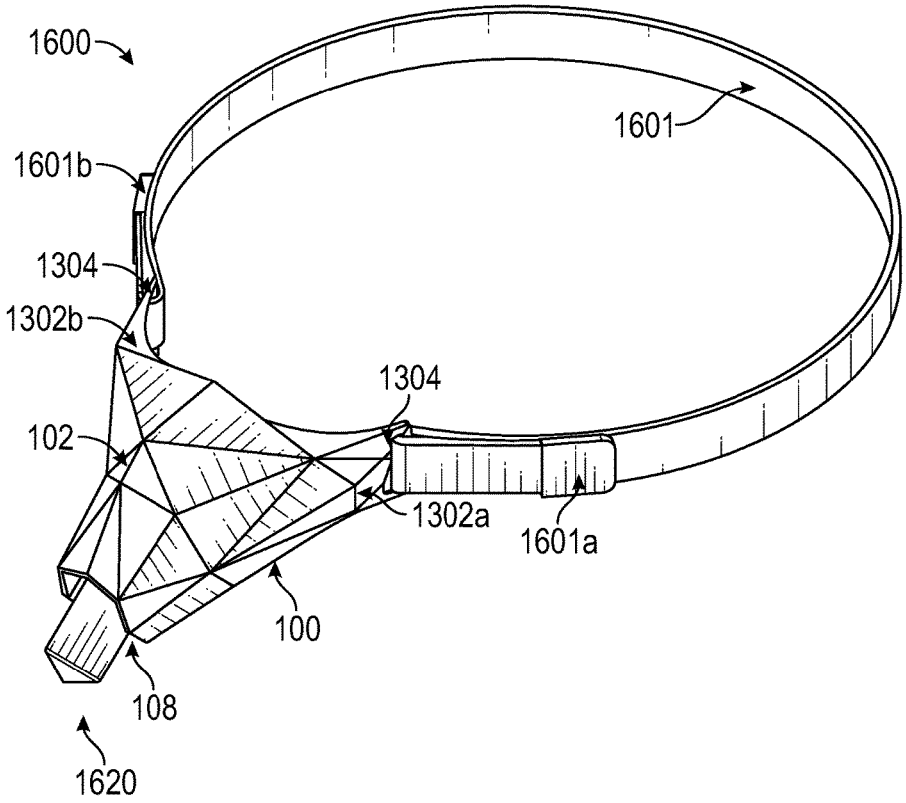
FIGS. 16-16E illustrate an embodiment of a modular necktie that employs a collar band.
Figure 16B:
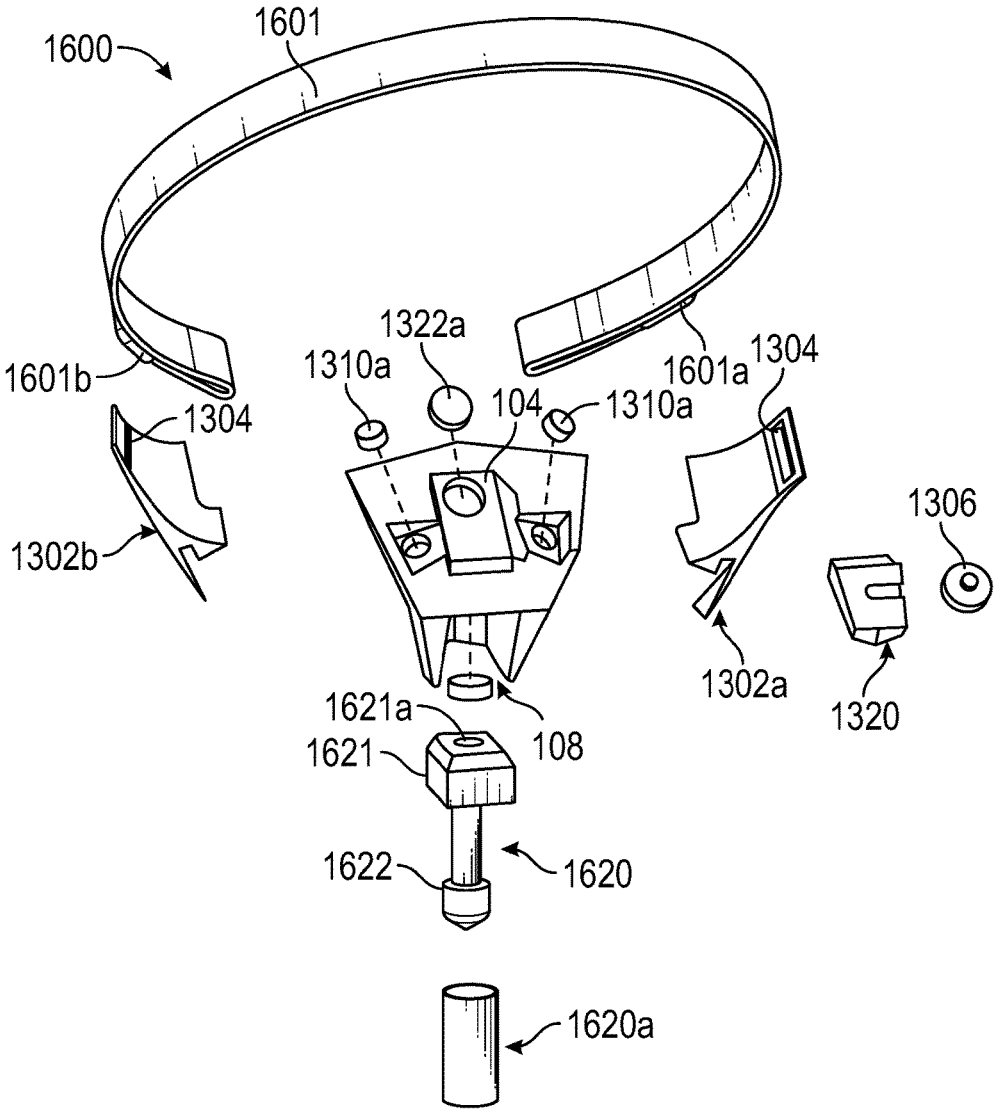

FIG. 16B provides an exploded view of modular necktie 1600 and substantially resembles the exploded view in FIG. 14. Modular necktie 1600 employs a fabric stem 1620 that is configured differently from fabric stem 200. Fabric stem 1620 includes a proximal head 1621 and a terminal fastener 1622 similar to fabric stem 200 but does not include bulbous flanges. Instead, fabric stem 1620 includes a locking sleeve 1620*a* into which terminal fastener 1622 inserts and locks to couple together the two pieces. Locking sleeve 1620*a* can be coupled to a tie portion (e.g., by sewing or gluing locking sleeve 1620*a* within the proximal end of the tie portion) and then fabric stem 1620 can be inserted through locking sleeve 1620*a*.

As shown, a magnet 1621*a* can be incorporated into proximal head 1621. A corresponding magnet 108 can be incorporated into the top surface of attachment channel 108 so that fabric stem 1620 will be held securely within attachment channel 108.

Figure 16C:
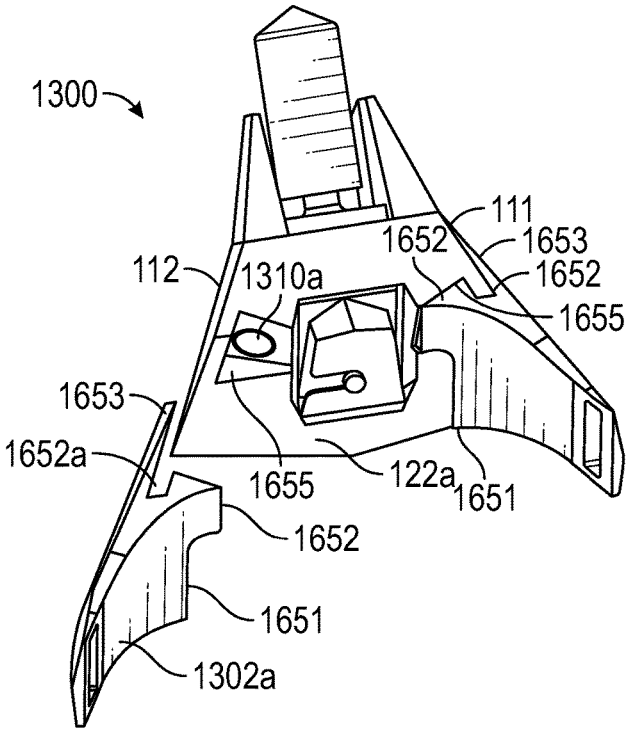
Figure 16D:
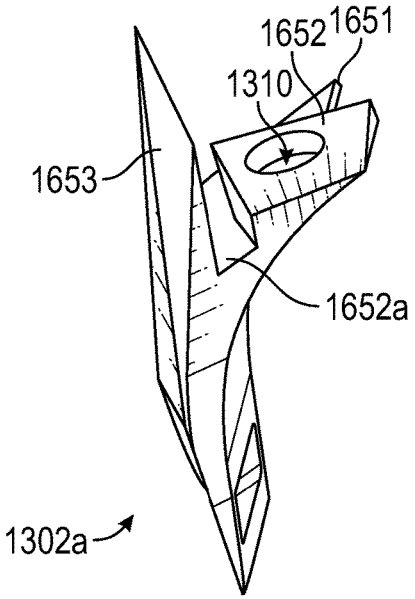

FIGS. 16C and 16D better illustrate how lateral collar wings 1302*a* and 1302*b* couple to knot enclosure 1300. Top rear surface 122*a* of knot enclosure 1300 includes a recessed portion 1655 on opposite sides of attachment recess 104. Each of lateral collar wings 1302*a* and 1302*b* includes a corresponding protrusion 1652 that protrudes downwardly from a bottom edge 1651. Bottom edge 1651 is configured to align with and rest against top rear surface 122*a* when protrusion 1652 inserts into recessed portion 1655. A magnet 1310*a* (or other type of fastener) can be contained in recessed portion 1655 to couple to a corresponding magnet 1310 (or other type of fastener) contained in protrusion 1655.

Each of lateral collar wings 1302*a* also includes an outer surface 1653 that extends downwardly beyond protrusion 1652 and aligns with the corresponding side 111 or 112 of knot enclosure 1300. A channel 1652*a* is formed between outer surface 1653 and protrusion 1652. A portion of top rear surface 122*a* inserts into channel 1652*a* when lateral collar wings 1302*a* and 1302*b* are coupled to knot enclosure 1300 to thereby reinforce the coupling.

Figure 16E:
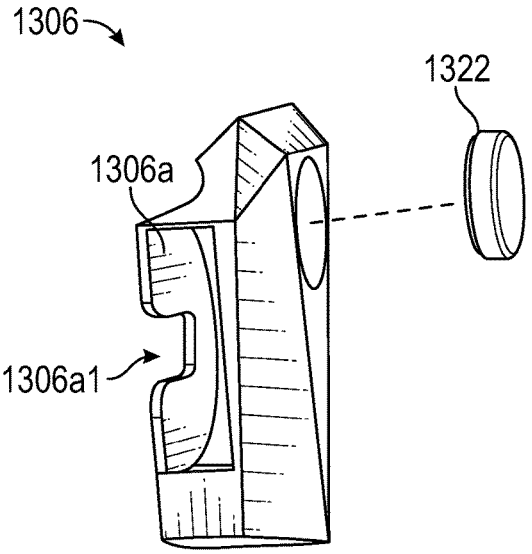

FIG. 16E illustrates button attachment component 1320 in isolation. As mentioned above, button attachment component 1320 is separable from knot enclosure 1300 to thereby allow button attachment component 1320 to be secured to the wearer's top button. A pocket 1306*a* may be formed within button attachment component 1320 and can be sized and shaped to snugly receive a button. Pocket 1306*a* may open at one side of button attachment component 1320. A notch 1306*a*1 can be formed centrally in this opening so that the threads that couple the button to the shirt can be positioned within notch 1306*a*1 when button attachment component 1320 is slid onto the button. Button attachment component 1320 can include magnet 1322 that secures to corresponding magnet 1322*a* contained within attachment recess 104.

Figure 17A:
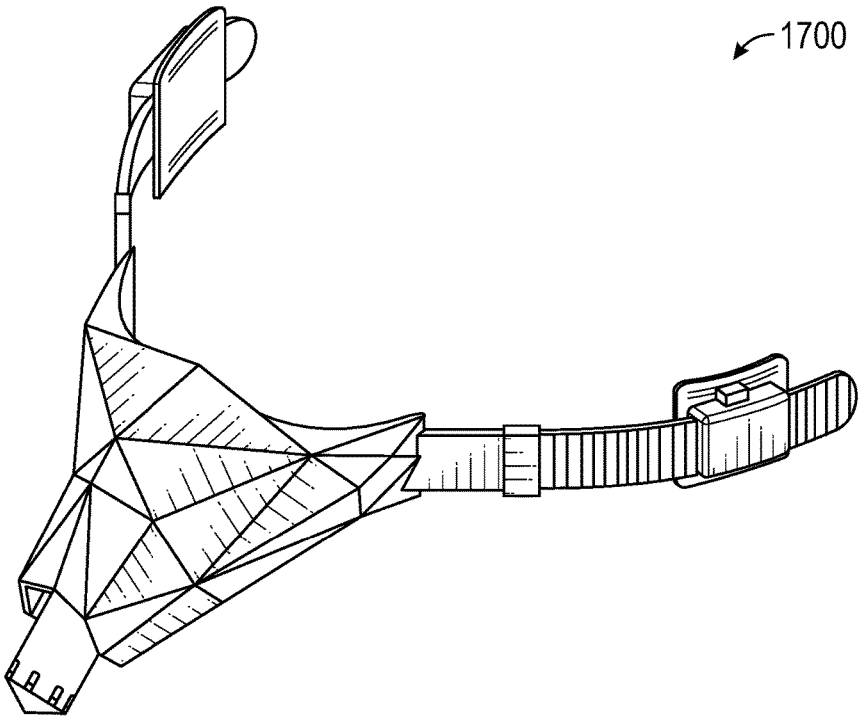
FIGS. 17A and 17B illustrate an embodiment of a modular necktie that employs a ratcheting system.
Figure 17B:
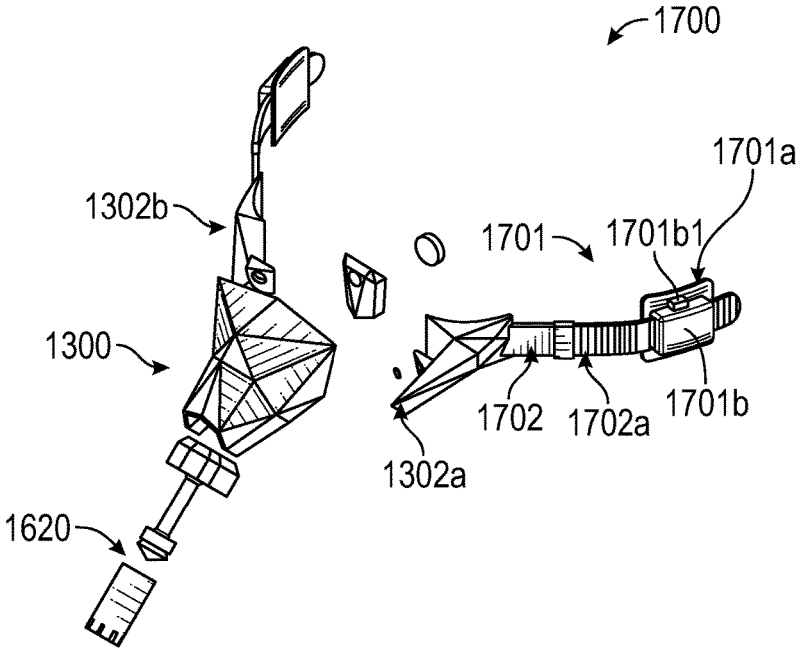

FIGS. 17A and 17B illustrate another embodiment of a modular necktie 1700. Modular necktie 1700 is the same as modular necktie 1600 except that collar band 1601 is replaced with two ratcheting strips 1702. Ratcheting strips 1702 can couple to knot enclosure 1300 via collar band fasteners 1304 via any suitable arrangement.

To secure ratcheting strips 1702 to the wearer's shirt, a receptacle 1701 can be secured under the collar on both sides of the shirt. Receptacle 1701 can include an attachment portion 1701*a* that faces inwardly and is configured to attached to the shirt via stitching, glue, or any other suitable mechanism. Receptacle 1701 also includes a ratcheting structure 1701*b* through which the corresponding ratcheting strip 1701 inserts. Ridges 1702*a* on ratcheting strip 1702 interface with ratcheting structure 1701*b* to prevent ratcheting strip 1702 from withdrawing from receptacle 1701 without disengaging release lever 1701*b*1. Accordingly, the wearer can insert ratcheting strips 1701 through receptacles 1701 to an appropriate distance to position and secure knot enclosure 1300 at the desired location. Because receptacles 1701 can be coupled under the wearer's collar, they will not be visible while the collar is folded down.

Figure 18A:
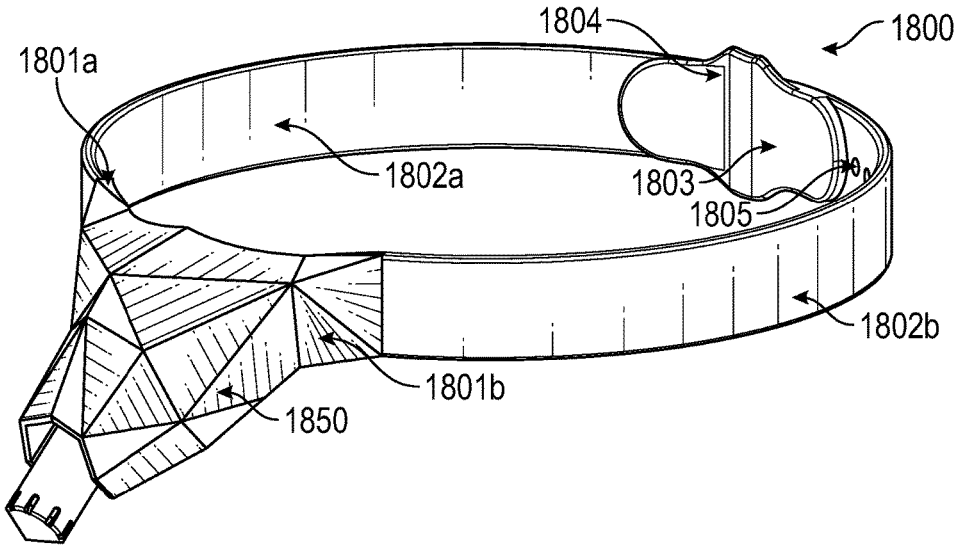
FIGS. 18A-18C illustrate an embodiment of a modular necktie that employs another collar band.
Figure 18B:
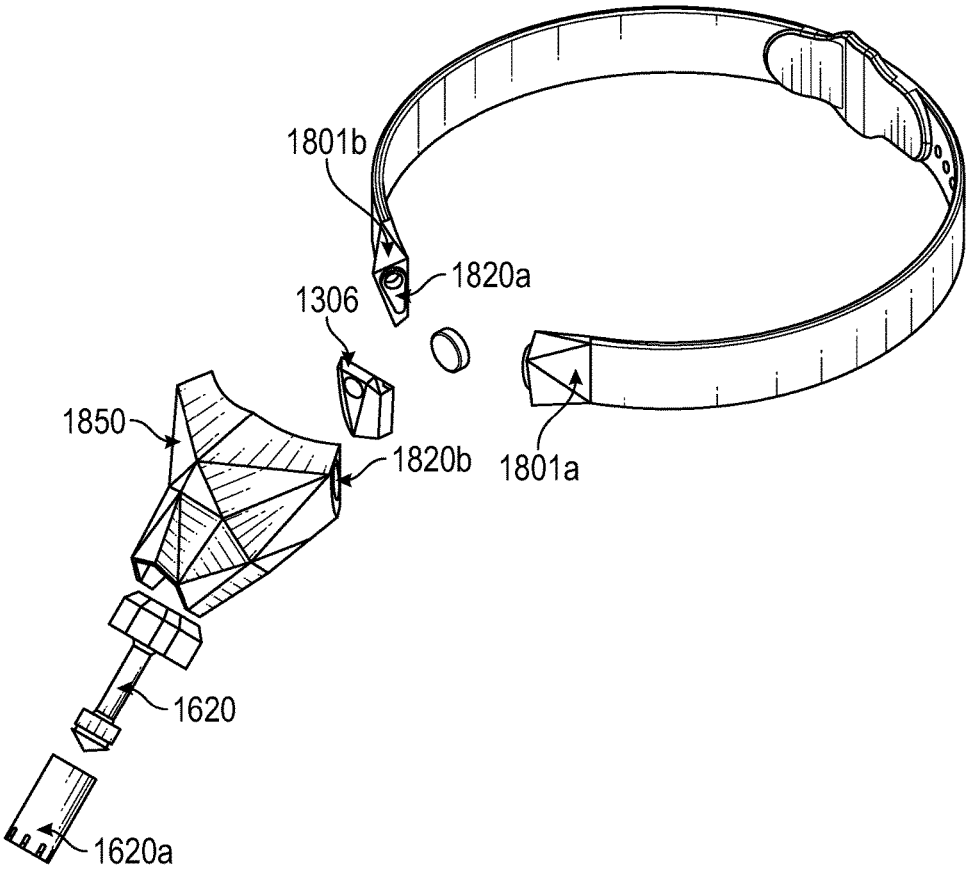
Figure 18C:
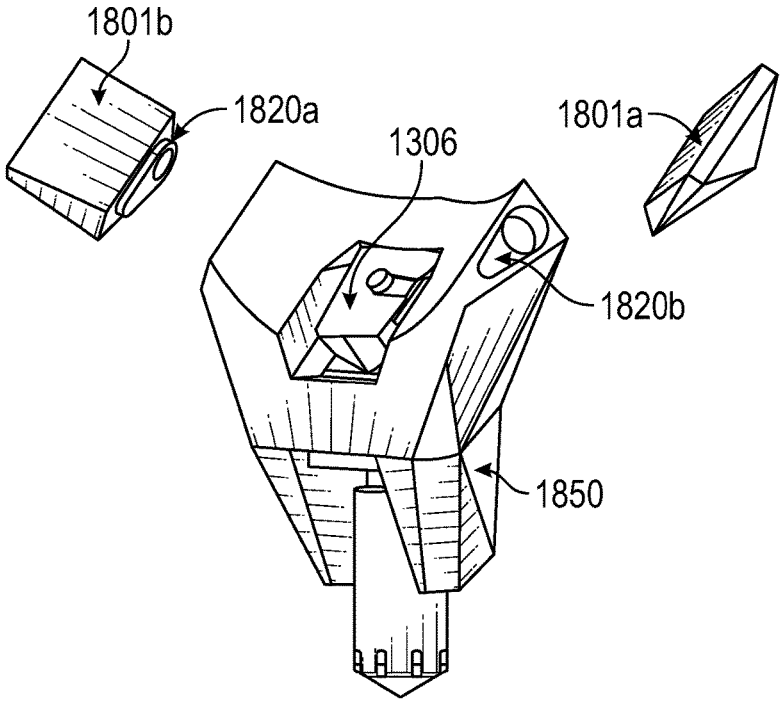

FIGS. 18A-18C illustrate another embodiment of a modular necktie 1800. Modular necktie 1800 is similar to modular neckties 1600 and 1700 except that a knot enclosure 1850 has a slightly different shape and interconnects with lateral collar wings 1801*a* and 1801*b* in a slightly different manner. Additionally, modular necktie 1800 includes a collar band formed of two straps 1802*a* and 1802*b*.

As best seen in FIGS. 18B and 18C, knot enclosure 1850 includes recesses 1820*b* at the upper end of each side. Recesses 1820*b* are configured to house a magnet (e.g., within an embedded recess). Each of lateral collar wings 1801*a* and 1801*b* includes a protrusion 1820*a* that corresponds to recess 1820*b* to allow protrusion 1820*a* to insert into recess 1820*b*. Protrusion 1820*a* can also be configured to house a magnet (e.g., within a recess) that aligns with the magnet housed in the corresponding recess 1820*b*. Accordingly, when protrusion 1820*a* inserts into recess 1820*b*, lateral collar wing 1801*a* or 1801*b* will be coupled to knot enclosure 1850 via magnetic force. Other types of coupling mechanisms could be used in place of magnets including temporary and semi-permanent coupling mechanisms.

Straps 1802*a* and 1802*b* connect at one end to lateral collar wing 1801*a* and 1801*b* respectively. The opposite ends of straps 1802*a* and 1802*b* are configured to interconnect in an adjustable manner thereby allowing the diameter of the collar band to be adjusted. In particular, the end of strap 1802*a* forms a buckle-like structure 1803 and channel 1804. The end of strap 1802*b* can be inserted through channel 1804 to a desired distance to form a loop. Straps 1802*a* and 1802*b* can then be secured together by inserting a pin (not visible) formed on buckle-like structure 1803 into one of notches 1805 that are formed along the end of strap 1802*b*. The pin on buckle-like structure 1803 can be oriented outwardly so that the end of strap 1802*b* inserts inwardly through channel 1804 thereby ensuring that the end of straps 1802*a* and 1802*b* will lie flat under the collar.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A modular necktie comprising:

a knot enclosure having a top edge, a bottom edge opposite the top edge, a front surface, and a rear surface opposite the front surface, the knot enclosure including an attachment channel that extends vertically within the knot enclosure and includes an opening at the bottom edge;

a fabric stem that is configured to insert into the attachment channel and to couple to a surface within the attachment channel; and a tie portion that is secured to the fabric stem such that the tie portion extends downwardly from the knot enclosure when the fabric stem is inserted into the attachment channel;

wherein the rear surface of the knot enclosure includes a button attachment component that forms a pocket within the rear surface, the pocket having an opening by which a button of a wearer's shirt can be slid into the pocket, the opening including a notch for receiving threads that couple the button to the wearer's shirt when the button is slid into the pocket.

2. The modular necktie of claim 1, wherein the button attachment component is configured to selectively couple to and uncouple from the knot enclosure.

3. The modular necktie of claim 2, wherein the button attachment component is selectively coupled within a recess in the rear surface.

4. The modular necktie of claim 1, wherein the pocket of the button attachment component is contained within a recess in the rear surface of the knot enclosure.

5. The modular necktie of claim 3, wherein the button attachment component and the recess each include a magnet for securing the button attachment component within the recess.

6. The modular necktie of claim 4, wherein the rear surface comprises a top rear surface and a bottom rear surface, the top rear surface being angled relative to the bottom rear surface, the recess being formed in the top rear surface.

7. The modular necktie of claim 6, wherein the recess extends through the bottom rear surface.

8. The modular necktie of claim 1, wherein the fabric stem includes a magnet by which the fabric stem couples to the surface within the attachment channel.

9. The modular necktie of claim 1, wherein the rear surface comprises a top rear surface and a bottom rear surface, the top rear surface being angled relative to the bottom rear surface, the attachment channel forming a rearward facing opening that extends vertically along the bottom rear surface.

10. The modular necktie of claim 1, wherein the fabric stem comprises a proximal head that couples to the surface within the attachment channel and a shank that extends downwardly from the proximal head, the proximal head including an upwardly tapered surface.

11. The modular necktie of claim 10, wherein the tie portion is secured to the shank.

12. A modular necktie comprising:

a knot enclosure having a top edge, a bottom edge opposite the top edge, a front surface, and a top rear surface and bottom rear surface opposite the front surface, the top rear surface being angled relative to the bottom rear surface, the front surface being convex and the top rear surface being concave between opposing sides of the top rear surface, the knot enclosure including an attachment channel that extends vertically within the knot enclosure and includes an opening at the bottom edge;

a fabric stem that is configured to insert into the attachment channel and to couple to a surface within the attachment channel; and a tie portion that is secured to the fabric stem such that the tie portion extends downwardly from the knot enclosure when the fabric stem is inserted into the attachment channel;

wherein the concave top rear surface of the knot enclosure includes a button attachment component that forms a pocket within the concave top rear surface, the pocket having an opening by which a button of a wearer's shirt can be slid into the pocket, the opening including a notch for receiving threads that couple the button to the wearer's shirt when the button is slid into the pocket.

13. The modular necktie of claim 12, wherein the pocket of the button attachment component is contained within a recess in the concave top rear surface of the knot enclosure.

14. The modular necktie of claim 13, wherein the recess extends through the bottom rear surface.

15. The modular necktie of claim 13, wherein the button attachment component is configured to selectively couple to and uncouple from the knot enclosure within the recess.

16. The modular necktie of claim 12, wherein the attachment channel forms a rearward facing opening that extends vertically along the bottom rear surface.

17. The modular necktie of claim 12, wherein the fabric stem comprises a proximal head that couples to the surface within the attachment channel and a shank that extends downwardly from the proximal head, the proximal head including an upwardly tapered surface.

18. A modular necktie comprising:

a knot enclosure having a top edge, a bottom edge opposite the top edge, a front surface, and a top rear surface and bottom rear surface opposite the front surface, the top rear surface being angled relative to the bottom rear surface, the front surface being convex and the top rear surface being concave between opposing sides of the top rear surface, the knot enclosure including an attachment channel that extends vertically within the knot enclosure and includes an opening at the bottom edge, the attachment channel forming a rearward facing opening that extends vertically along the bottom rear surface;

a fabric stem that is configured to insert into the attachment channel and to couple to a surface within the attachment channel; and a tie portion that is secured to the fabric stem such that the tie portion extends downwardly from the knot enclosure when the fabric stem is inserted into the attachment channel.

19. The modular necktie of claim 18, wherein the fabric stem comprises a proximal head that couples to the surface within the attachment channel and a shank that extends downwardly from the proximal head, the proximal head including an upwardly tapered surface.

20. The modular necktie of claim 18, wherein the top rear surface forms a recess for receiving a button of a wearer's shirt within the top rear surface, the recess being configured to secure the button within the recess such that the modular necktie remains coupled to the wearer's shirt.

* * * * *